US005582087A

United States Patent [19]

Crowley et al.

[11] Patent Number: 5,582,087

[45] Date of Patent: Dec. 10, 1996

[54] HIGH SPEED SHEET FEEDER

[75] Inventors: H. W. Crowley, Newton; John W. Clifford, Ashland; William F. Bolza, Chelmsford, all of Mass.

[73] Assignee: Roll Systems, Inc., Burlington, Mass.

[21] Appl. No.: 131,478

[22] Filed: Oct. 4, 1993

Related U.S. Application Data

[63] Continuation-in-part of Ser. No. 773,887, Jun. 24, 1991, which is a continuation-in-part of Ser. No. 536,214, Jun. 11, 1990, Pat. No. 5,130,724.

[51] Int. Cl.[6] ..... B65H 29/00

[52] U.S. Cl. ..... 83/155; 346/136; 271/185; 101/232

[58] Field of Search ..... 83/155, 156, 165; 346/136; 271/185, 225; 101/232

[56] References Cited

U.S. PATENT DOCUMENTS

| | | | |
|---|---|---|---|
| 3,639,053 | 2/1972 | Spear, Jr. . | |
| 3,670,612 | 6/1972 | Johnson et al. | 83/99 |
| 3,709,492 | 1/1973 | Baker et al. . | |
| 3,718,394 | 2/1973 | Tysko et al. . | |
| 4,009,957 | 3/1977 | Suzuki et al. . | |
| 4,012,139 | 3/1977 | Washio et al. . | |
| 4,318,540 | 3/1982 | Paananen et al. . | |
| 4,669,719 | 6/1987 | Fratangelo | 271/251 |
| 4,817,933 | 4/1989 | Honjo et al. | 271/3.1 |
| 4,893,763 | 1/1990 | Wales et al. . | |
| 4,933,727 | 6/1990 | Mizuma et al. . | |
| 4,941,377 | 7/1990 | Ishihara et al. . | |
| 5,004,220 | 4/1991 | Dreschel et al. | 271/184 |
| 5,130,724 | 7/1992 | Crowley . | |

FOREIGN PATENT DOCUMENTS

| | | |
|---|---|---|
| 55-115035 | 9/1980 | Japan . |
| 391632 | 10/1990 | Japan . |

*Primary Examiner*—Rinaldi I. Rada
*Assistant Examiner*—Elizabeth Stanley
*Attorney, Agent, or Firm*—Cesari and McKenna

[57] ABSTRACT

A high speed sheet feeder for use with utilization devices that process sheets comprises a source of sheets, that can include a web cutter and a transport unit having a surface along which the sheets travel in a downstream direction. The surface can include a pair of conveyors that act as sheet justifiers and have at downstream ends thereof wait stations that can comprise pairs of nip rollers. Sheets are halted at each wait station and simultaneously passed along the surface as a sheet request signal is received from the utilization device. The transport unit can further include a bump/turn module that receives sheets from the conveyors and passes them at a 90° angle to their initial direction of travel into the utilization device via a port in the utilization device adapted to feed sheets upon request.

19 Claims, 12 Drawing Sheets

HIGH SPEED SHEET FEEDER

RELATED APPLICATION

This application is a continuation in part of co-pending U.S. patent application Ser. No. 07/773,887 filed Jun. 24, 1991, which is a continuation in part of copending U.S. patent application Ser. No. 07/536,214 filed Jun. 11, 1990, now U.S. Pat. No. 5,130,724.

FIELD OF THE INVENTION

This invention relates to a high speed sheet feeder and more particularly to a sheet feeder that interfaces with high production printers and photocopiers having a port adapted for receiving sheets from an external sheet feeder.

BACKGROUND OF THE INVENTION

It is often desirable to provide cut sheets to a printer or other web or sheet utilization device from a high volume source such as a roll. Most utilization devices are not adapted to receive an uncut continuous web. Rather, utilization devices typically require a stack of cut sheets to be positioned at a feed location in which the sheets are deshingled and routed through the utilization device as needed.

Applicants related U.S. Pat. No. 5,130,724 and co-pending continuation-in-part Application Ser. No. 07/773,887 each disclose systems for directly feeding sheets to utilization devices adapted for normally accepting stacks of cut sheets. The directly fed sheets can be derived from rolls of continuous web that are separated by an external cutter. According to this invention, sheets are delivered (replenished) on demand to the stack feed location of the utilization device as sheets are drawn from the stack by the utilization device. The disclosures of U.S. patent application Ser. No. 07/773,887 and U.S. Pat. No. 5,130,724 are hereby expressly incorporated herein by reference.

The method and apparatus disclosed by each of the prior related applications relate essentially to the provision of sheets to a utilization device not normally adapted for receiving a direct stream of sheets derived, typically, from a continuous web. Hence, the teachings of these applications are directed largely toward the delivery of sheets at selected times to the utilization device stack feed location without direct interconnection or communication between the utilization device and the external feeder and cutter. As high volume web handling and production versatility become more important, utilization devices are now beginning to incorporate specific ports and communication linkages to enable interactive coupling between an external feed unit and the utilization device. One particular utilization device, the Xerox 4135 series laser printer, is so adapted to enable interactive interface with an external feed unit.

In view of the above-described prior art, it is an object of this invention to provide an external high speed sheet feeder unit with a capability of directly interfacing with a utilization device having a port for receiving sheets. It is another object of this invention to provide a sheet feeder having a configuration that does not interfere with normal functioning of the utilization device and that allows further expansion of the utilization device via other ports.

SUMMARY OF THE INVENTION

A high speed sheet feeder according to a preferred embodiment of the invention provides a transport unit that receives sheets from a sheet source. The sheet source typically comprises a cutter that cuts sheets from a continuous web. The transport device is preferably inclined downwardly in a downstream direction according to this embodiment. The transport device includes a pair of sheet justifiers that comprise angled belts and overlying weighted balls. The belts move sheets downstream along the transport unit and also force the sheets against an edge guide. By choosing the weight of the balls and the friction coefficient of the belts, along with the angle of the belts once the sheets engage the edge guide, they are maintained against the edge guide with slippage and do not buckle due to the transverse component of force. Thus, justified sheets are driven downstream along the transport unit. Each belt has associated therewith a wait station that, in this embodiment, comprises a plurality of confronting nip rolls. The nip rolls drawn in and hold a leading edge of sheets transferred downstream by the belts. Each pair of nip rolls has associated therewith a sensor that senses the presence of a sheet at the nip rolls. A controller responds to signals generated by the sensors to hold sheets in place, typically, by deactivating the nip rolls and justifier once the sheet is held within the nip rolls.

Downstream of the inclined transport unit according to this embodiment is positioned a bump/turn module. The bump/turn module according to this embodiment includes a plurality of rollers having axes of rotation that are parallel and at an acute angle relative to the direction of sheet movement into the bump/turn module from the upstream wait stations. According to one embodiment, an acute angle of approximately 15° can be utilized. The angled rollers receive sheets from the upstream nip rolls at a predetermined time and drive the sheets into an edge guide positioned opposite the upstream nip rolls. The sheet is blocked by the edge guide and, thus, is translated at a right angle relative to its direction of travel out of the nip rolls. The sheet travels into a third wait station having a set of nip rolls. A sensor located adjacent the third wait station signals the controller to pause the sheet and deactivates the bump/turn rollers.

When a sheet request signal is received from a utilization device, a sheet in the third wait station is driven into a port of the utilization device located adjacent the third wait station. Substantially simultaneously, sheets are transferred from the first wait station to the second wait station and from the second wait station to the bump/turn module and, hence, to the third wait station. An additional sheet from the source is driven into the first wait station at approximately this time also. Sheets are continually transferred from the source downstream through each wait station and into the port in succession as additional printer request signals are received from the utilization device. The utilization device is interfaced with the sheet feeder according to this invention via a communication line that interconnects the controller to the utilization device.

BRIEF DESCRIPTION OF THE DRAWINGS

The foregoing and other objects of this invention will become more clear with reference to the following detailed description as illustrated by the drawings in which.

DETAILED DESCRIPTION OF THE PREFERRED EMBODIMENTS

Figure 1:
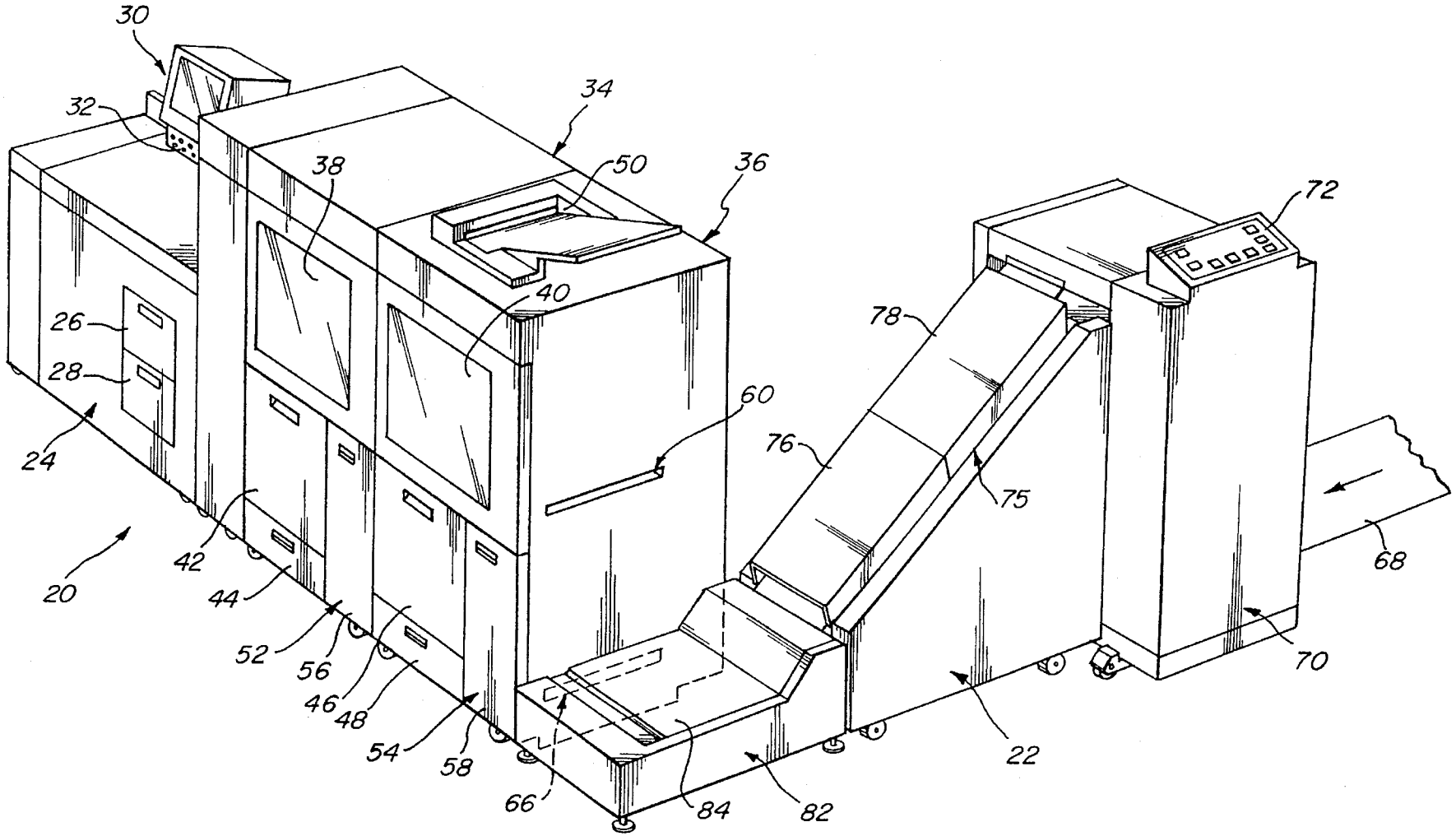
FIG. 1 is a perspective view of a utilization device interconnected with a high speed sheet feeder according to this invention.

FIG. 1 illustrates a utilization device, which, for the purposes of this disclosure, comprises a high capacity laser printer 20 interfaced with a high speed sheet feeder 22 according to this embodiment. The laser printer 20 illustrated is a Model 4135 system manufactured by the Xerox Corporation. However, the high capacity sheet feeder according to this invention can be utilized with any utilization device that accepts a stream of cut sheets. As used herein, the term "utilization device" shall refer to any such device and the terms utilization device and "printer" shall be used interchangeably.

The Xerox 4135 printer 20 as illustrated includes a main printer unit 24 having conventional feed drawers 26 and 28 for holding stacks of cut sheets to be printed upon. The printer unit 24 includes a CRT display 30 interconnected with control panel 32 that can include a keyboard (not shown). The main printer unit 24 is mated with a pair of auxiliary high capacity feed units 34 and 36. In this embodiment, each high capacity feed unit 34 and 36 includes a respective upper door-accessed output stack shelf 38 and 40, respectively, and a corresponding lower pair of feed drawers 42, 44, 46 and 48 capable of holding sheet stacks of various sizes and dimensions. As described further below, each auxiliary feed unit 34 and 36 includes a raceway that allows sheets to move in each of opposite directions between the auxiliary feed units 34 and 36 and into and out of the main printer unit 24. Routing of sheets through the raceway can be controlled via the control panel 32 and CRT 30. At least one of the auxiliary feed units 34 and/or 36 can include an external sheet feeder 50 for small printing jobs as shown.

Each auxiliary feed unit 34 and 36 according to this embodiment further includes a respective "document finishing architecture" or "DFA" module 52 and 54. The modules are accessed by respective doors 56 and 58 located to the side of the feed drawers. As described further below, the DFA 52 or 54 is adapted to allow entry of sheets into the raceway from an external location. The high speed sheet feeder 22 according to this embodiment interfaces with the DFA.

At the upstream (taken in a direction away from the main printer unit 24) end of the auxiliary feed unit 36 is positioned a port 60. The port 60 interfaces with the return raceway of the auxiliary feed units 34 and 36 (refer to raceway 198 in FIG. 5). The port 60 is adapted to interface with a further processing device or transport unit. Below the port 60 is positioned the raceway input port 66 or "DFA port" adjacent the DFA 54 of the upstream auxiliary feeder unit 36. The high speed sheet feeder 22 according to this embodiment is interfaced with this port 66. As discussed above, unlike more conventional printers and other utilization devices that draw utilized sheets from an inboard stack of pre-cut sheets, the Xerox 4135 printer system has the ability to prompt other devices for sheets when needed. The high speed sheet feeder 22 according to this embodiment is configured to supply sheets in response to such prompts.

According to this embodiment, the high speed sheet feeder 22 receives continuous web 68 from a source such as a roll stand (not shown). Web 68 is routed downstream into a cutter unit 70 that severs the leading end of the continuous web into sheets of predetermined size. The cutter 70 draws the web 68 from the source and positions a predetermined leading end length adjacent a cutter blade (not shown). Sheets are cut and output from the cutter unit 70 as requested. The cutter unit 70 includes a control panel 72 that interfaces with an electronic controller (see FIG. 3) that governs basic functions of the sheet feeder 22 of this embodiment, such as power on/off, emergency stop, and system override commands. Control of the cutter unit 70 is further described below.

Figure 2:
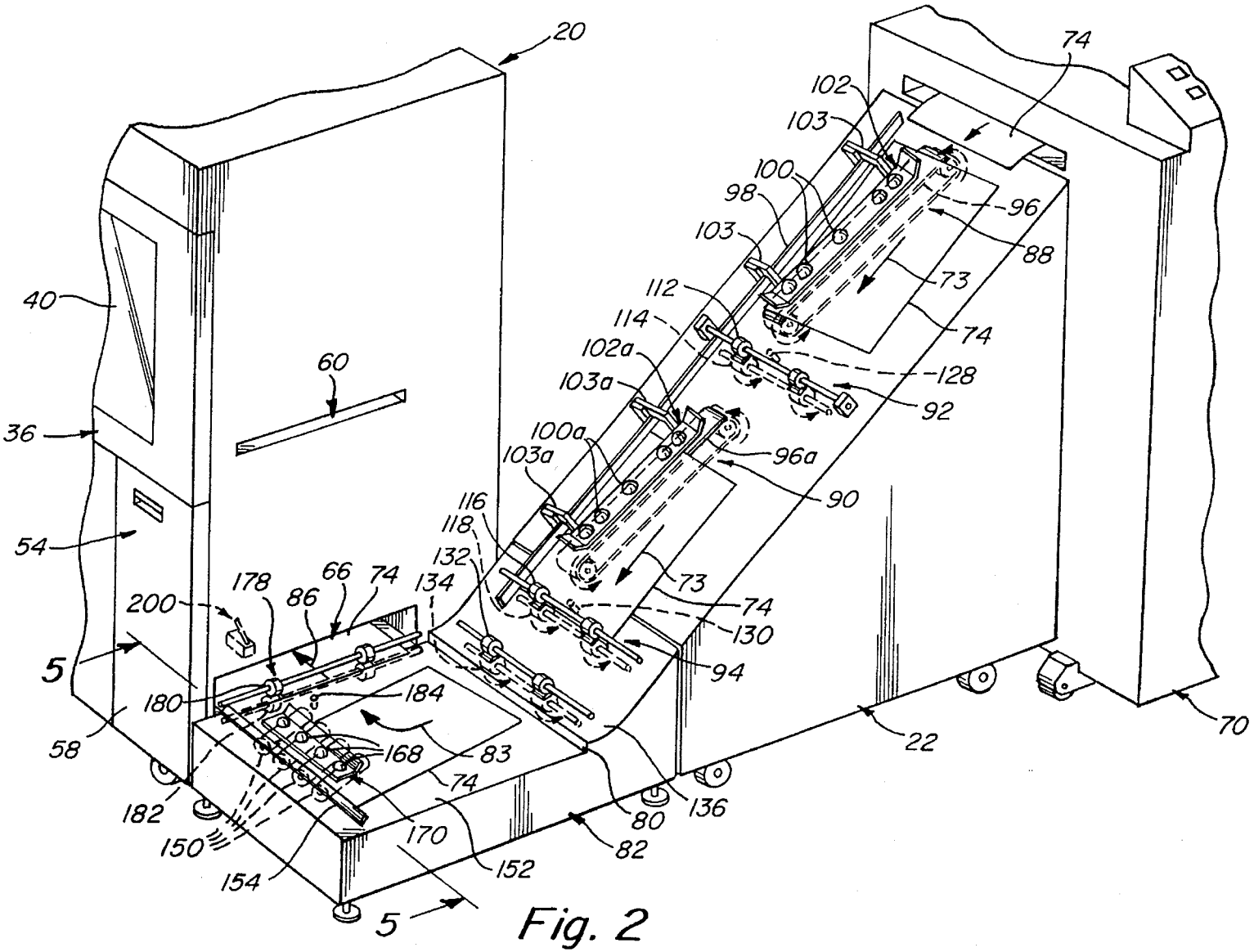
FIG. 2 is a more detailed partial schematic perspective view of the high speed sheet feeder and utilization device of FIG. 1.

As further detailed in FIG. 2, sheets 74 pass from the cutter 70 into a transport unit that comprises a downward sloping ramp 75 in this embodiment. The ramp is normally covered by a pair of removable translucent covers 76 and 78 (FIG. 1) that are removed to detail the mechanism of the ramp 75. Sheets 74 pass from the ramp 75 over a step 80 onto a bump/turn module 82 that translates the sheets at a right angle (curved arrow 83) relative to their passage (arrows 73) down the ramp 75. The bump/turn module 82 is also normally enclosed by a hinged and removable cover 84 (FIG. 1) that is shown removed for illustration.

The sheets are passed by the bump/turn module 82 into the DFA port 66 of the auxiliary feed unit 36. Since most printers are oriented to feed sheets so that the narrower widthwise direction is aligned with the direction of movement through the printer (the "landscape" orientation), the sheets 74 in this embodiment proceed down the feeder ramp with their longer lengthwise direction aligned with the direction of movement (arrows 73). The bump/turn module 82 then passes the sheets 74 at a right angle (curved arrow 83) to the lengthwise directions so that the narrower widthwise direction is oriented with the final direction of feeding (arrow 86) into the printer system 20. Hence, for standard 8½×11 and 8½×14 inch sheets, the web source fed into the cutter typically has an 8½ inch width rather than an 11 inch or 14 inch width that is common for direct in-line feed embodiments.

As detailed in FIG. 2, the ramp 75 includes a pair of sheet justifiers 88 and 90 and corresponding nip rollers or "wait stations" 92 and 94 according to this embodiment. As each sheet 74 passes from the cutter 70, it encounters slanted belt 96 (refer also to FIGS. 7 and 8) of the first sheet justifier 88. The slanted belt 96 is angled in an upstream to downstream direction so that the belt 96 slants inwardly toward a raised edge guide 98 of the ramp 75. The edge guide 98 extends linearly in an upstream to downstream direction and can be angled slightly inwardly away from an adjacent edge of the ramp 75 to maintain sheets flatly against the ramp when they engage the guide 98. A set of ball bearings 100, that are ½ inch in diameter in this embodiment, rotate freely in respective holes in a frame 102 above the belt 96. Hence, as the sheet 74 is engaged between the belt 96 and the ball bearings 100, it is driven against the edge guide 98 and downwardly toward the first wait station 92. Note that the ball bearings 100 can rotate both in an upstream/downstream and transverse (to upstream/downstream) direction to account for movement of the sheet 74 both downstream toward the wait station 92 and traversely toward the edge guide 98.

Figure 6:
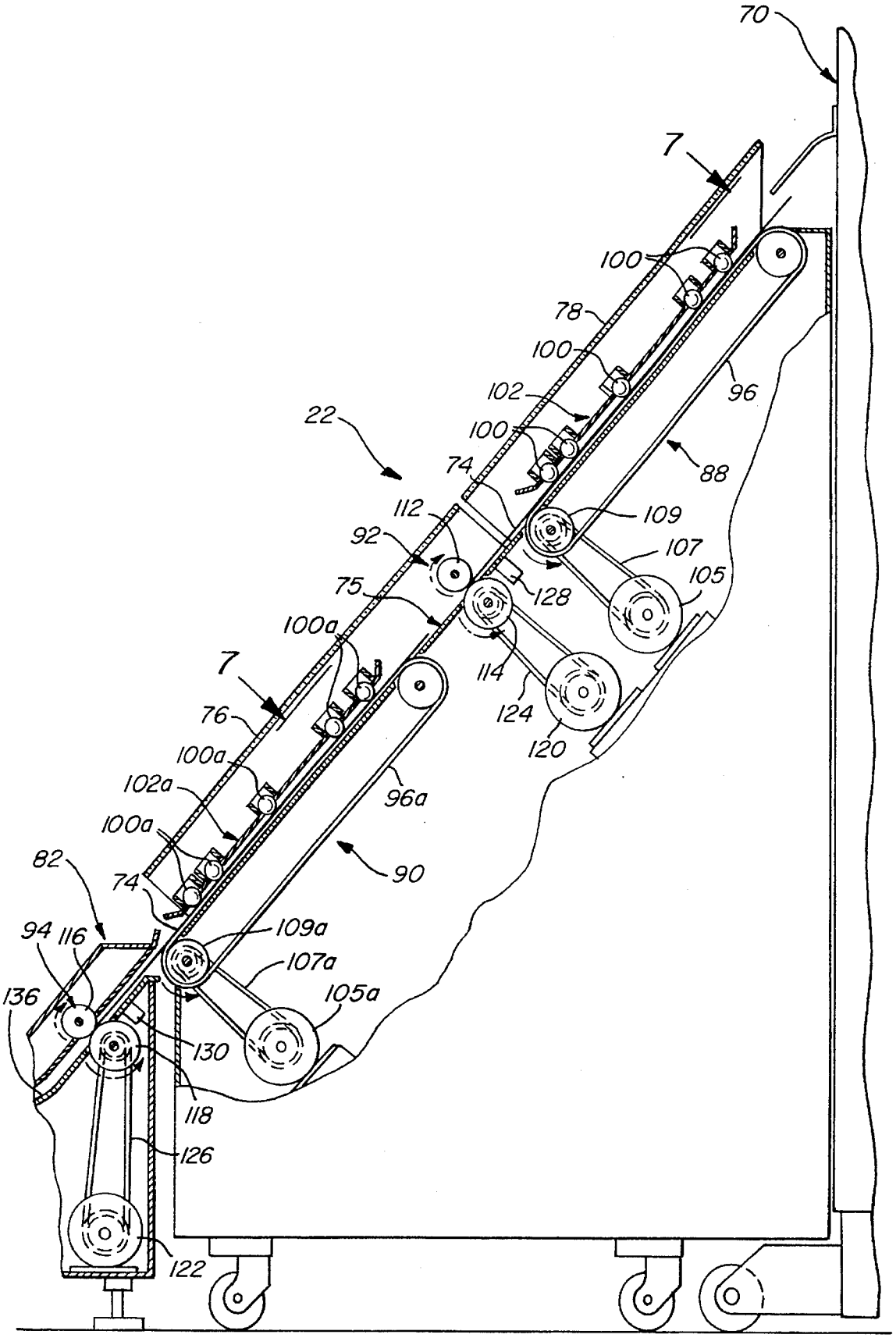
FIG. 6 is a partial exposed side view of the sheet feeder of FIG. 1.
Figure 7:
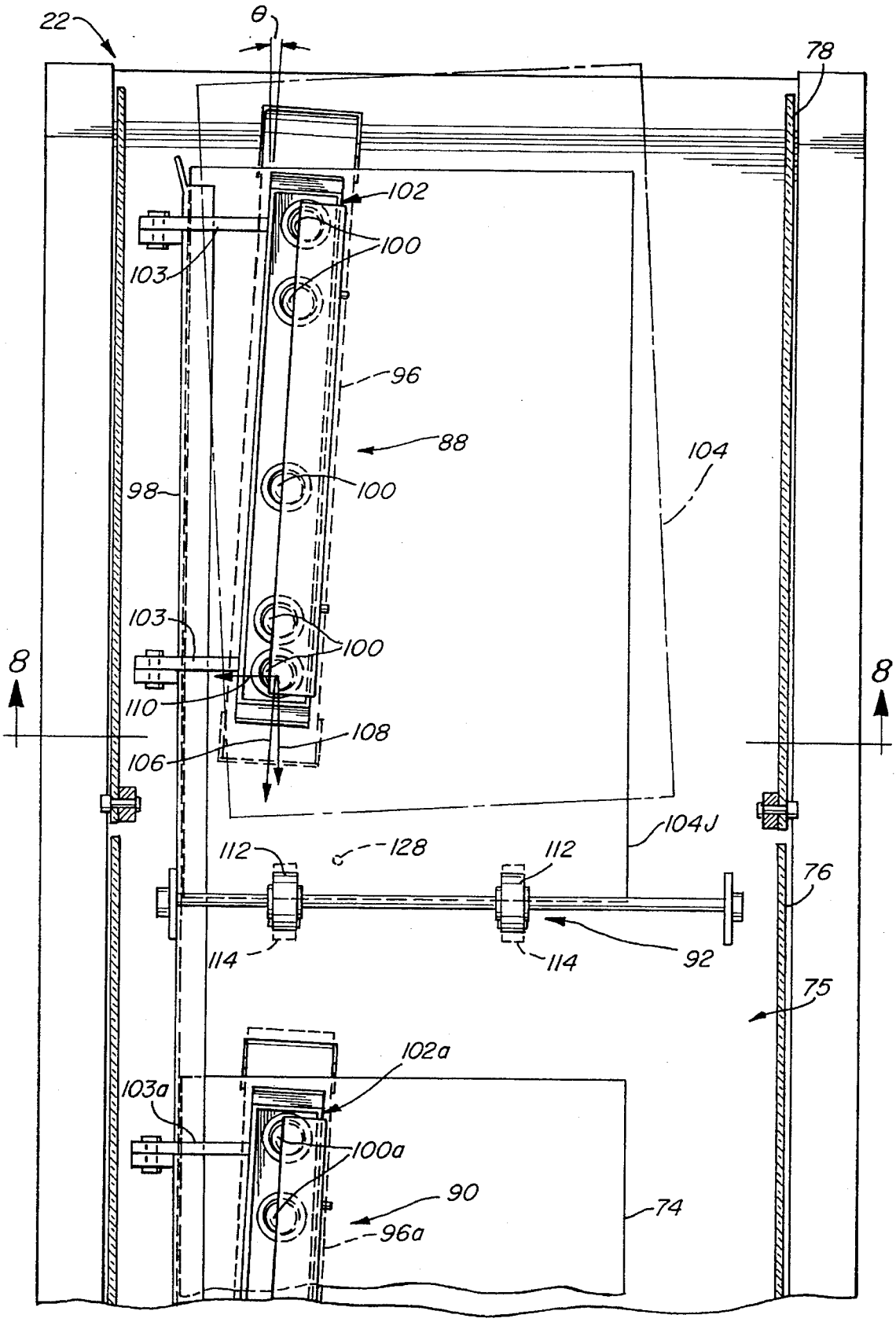
FIG. 7 is a partial schematic plan view of the sheet feeder taken along line 7—7 of FIG. 6.
Figure 8:
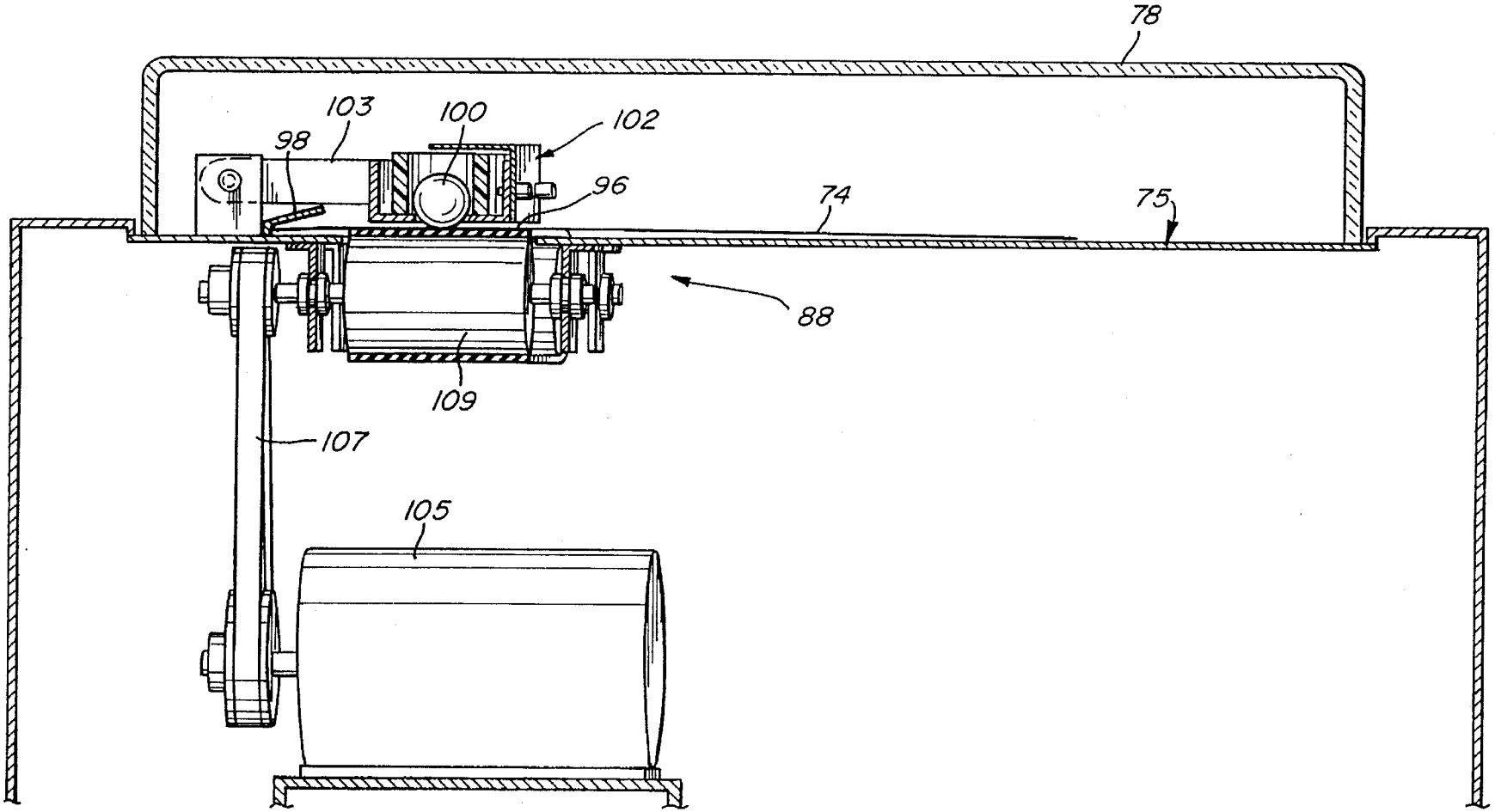
FIG. 8 is a cross-section taken along line 8—8 of FIG. 7.

The plan view of FIG. 7 further illustrates the justifying process. As illustrated, a skewed sheet 104 (shown in phantom) receives resolved forces 106 from the belt 96 in both a downstream direction (vector arrow 108) and a transverse direction (vector arrow 110) due to the belt's angular offset θ relative to the downstream direction. As further illustrated in FIG. 8, the balls 100 are supported in the holder frame 102 that is suspended over the belt 96 by means of a set of brackets 103 attached to the edge guide 98. The belt in this embodiment extends slightly above the surface of the ramp 75 and is driven by a motor 105 attached by a drive belt 107 to a drive roller 109. The belt and motor arrangement are further illustrated in the schematic view of FIG. 6. Since θ is typically between 0° to 10°, the downstream sheet driving force vector 108 is substantially greater than the transverse driving force vector 110. The transverse vector 110 is, however, great enough to insure justification of the sheet 104 against the edge guide 98. Hence, the depicted justified sheet 104J, is presented to the wait station 92.

The weighted balls 100 do not exert enough force to overcome transverse slippage of sheets relative to the belt 96 upon application of an opposing force. The natural rigidity of the sheets serves to prevent buckling when the sheets contact the edge guide 98, and the transverse component of force is largely taken up by slippage, and serves to maintain the sheets against the edge guide 98 as they are driven downstream. To ensure that buckling is prevented, the belts are located no more than approximately 2–4 inches away from the edge guide 98 for a standard letter size feed embodiment. This ensures that the area of sheet between the belt 96 and edge guide 98 is small enough to maintain substantial sheet rigidity.

The second sheet justifier 90 is substantially identical in structure and function to that of the first sheet justifier 88. Accordingly, identical elements shall be designated by the same reference number, but shall have the designating letter "a" appended thereto in the figures. Two sheet justifiers 88 and 90 are provided according to this embodiment to insure that sheets remain aligned along the entire distance of the feed ramp 75. A shorter or longer ramp can be utilized where required. Fewer or greater numbers of wait stations and justifiers can be provided depending upon the length of the transport unit and associated feed ramp. Similarly, while an inclined ramp 75 is shown according to this embodiment, the transport unit can be substantially horizontal, or can rise upwardly in a downstream direction depending upon the application. For the Xerox 4135 printer system, a port (port 66) positioned low on the feed unit makes a sheet feeder that transports sheets in a downward direction desirable.

As noted above, each of the first and second sheet justifiers 88 and 90 has associated therewith a wait station comprising nip rolls according to this invention. The nip rolls 112, 114, 116 and 118 are further detailed in FIGS. 6 and 7 and are driven by independent motors 120 and 122 and belts 124 and 126 according to this embodiment. Each nip roll pair 112 and/or 114, 116 and 118 (wait station 92 or 94 respectively) has associated therewith a sensor 128 and 130, respectively, that comprises an optical sensor according to this embodiment. When a sheet 74 is passed down the justifier 88 or 90 to the respective wait station 92 or 94, it encounters a respective sensor 128 or 130. The sensor 128, 130 triggers the "controller" of the sheet feeder which can comprise an on-board central processing unit (CPU), to be described further below) to register the presence of a sheet at the respective wait station. In response to such registration, the controller typically triggers the justifier 88 or 90 and nip roll pair 112 and 114 or 116 and 118 to deactivate, pausing the sheet within the nip rolls.

Note, that the wait stations shown and illustrated herein include drives that are adapted to stop or pause the sheets located at their nip rolls. Pausing is particularly desirable when the feeder is not in use but must be ready to direct sheets to the port 66 on command. However, it is contemplated that the drives can be responsive to the central processing unit to decrease or increase the driving speed of the nip rolls to meet the feed timing requirements of the utilization device. Hence, if the utilization device is requesting sheets at a relatively rapid rate, it may not be desirable to pause sheets at each wait station. Thus the wait stations are directed by the central processing unit to alter their drive speed. This alteration of drive speed essentially serves to sychronize the sheets relative to the sheet registration signal issued by the utilization device. The central processing unit carries out this synchronization by detecting the presence of sheets at each wait station (as described further below) and setting the wait station's drive speed (or drive start time, if sheets are paused thereat) so that the sheets arrive at the next downstream wait station (or the port in the case of wait station 178) within the feed time "window" specified by the utilization device. The speed and/or timing of drive of a given wait station is chosen by the central processing unit based upon the distance that each of the sheets must travel between that wait station and the next downstream wait station (or port). As used herein "synchronize" shall mean to drive sheets so that they are moved downstream within the time "window" required to deliver sheets to the port of the utilization device. "Pause," as used herein, shall include varying the operation speed of the wait stations, but not necessarily completely stopping the wait stations.

Figure 9:
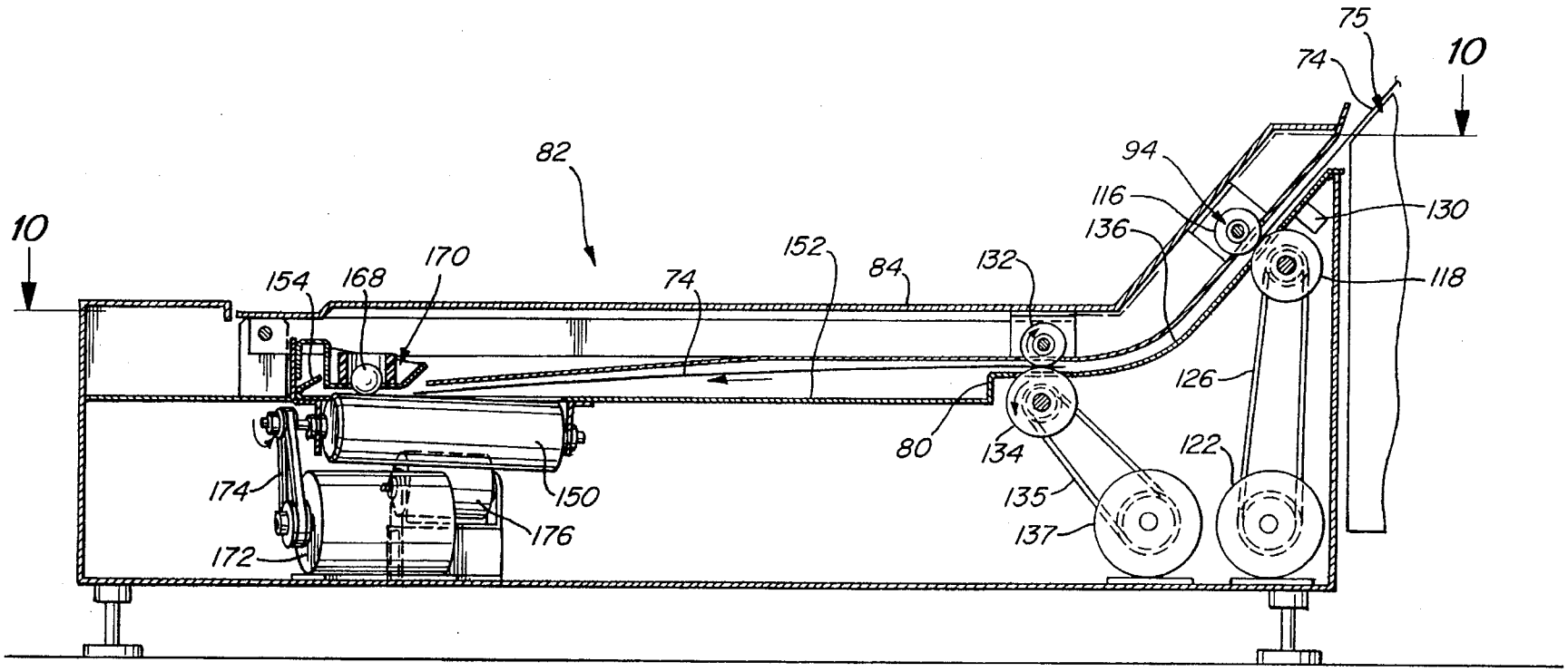
FIG. 9 is a partial schematic cross-section of the bump/turn unit of the sheet feeder of FIG. 1.

An additional pair of nip rolls 132 and 134 (FIGS. 2, 9 and 10) is provided adjacent the second wait station. The rolls 132 and 134 are driven by an independent belt 135 and motor 137 according to this embodiment. The ramp surface at this location includes a slight concave curve 136 that terminates at the step 80. As sheets are driven out of the second wait station 94, they are engaged by the downstream nip rolls 132 and 134 and driven over the step 80 onto the bump/turn module 82. The step 80 serves to prevent longer overlapping sheets (over 14 inches in length for example) from frictionally adhering to each other as the more downstream sheet is driven transversely (arrows 83 and 86) by the bump/turn module 82 into the DFA port 66. In this embodiment, the upper nip rolls 116 and 132 are mounted to a curved extension of the bump/turn module cover 84 and can be taken out of contact with their respective lower rolls 118 and 134 by pivoting the cover 84.

It should be noted that a bump/turn module 82 that drives sheets transversely (at a right angle) to their initial direction of feed is provided, according to the embodiment, so that the output port 60 is freely accessible by additional peripheral units. If the transport unit according to this invention were oriented in the direction of printer sheet feed motion (arrow 86, for example) then the output port 60 would be substantially blocked by the transport unit and further processing of output sheets could not be provided.

Figure 10:
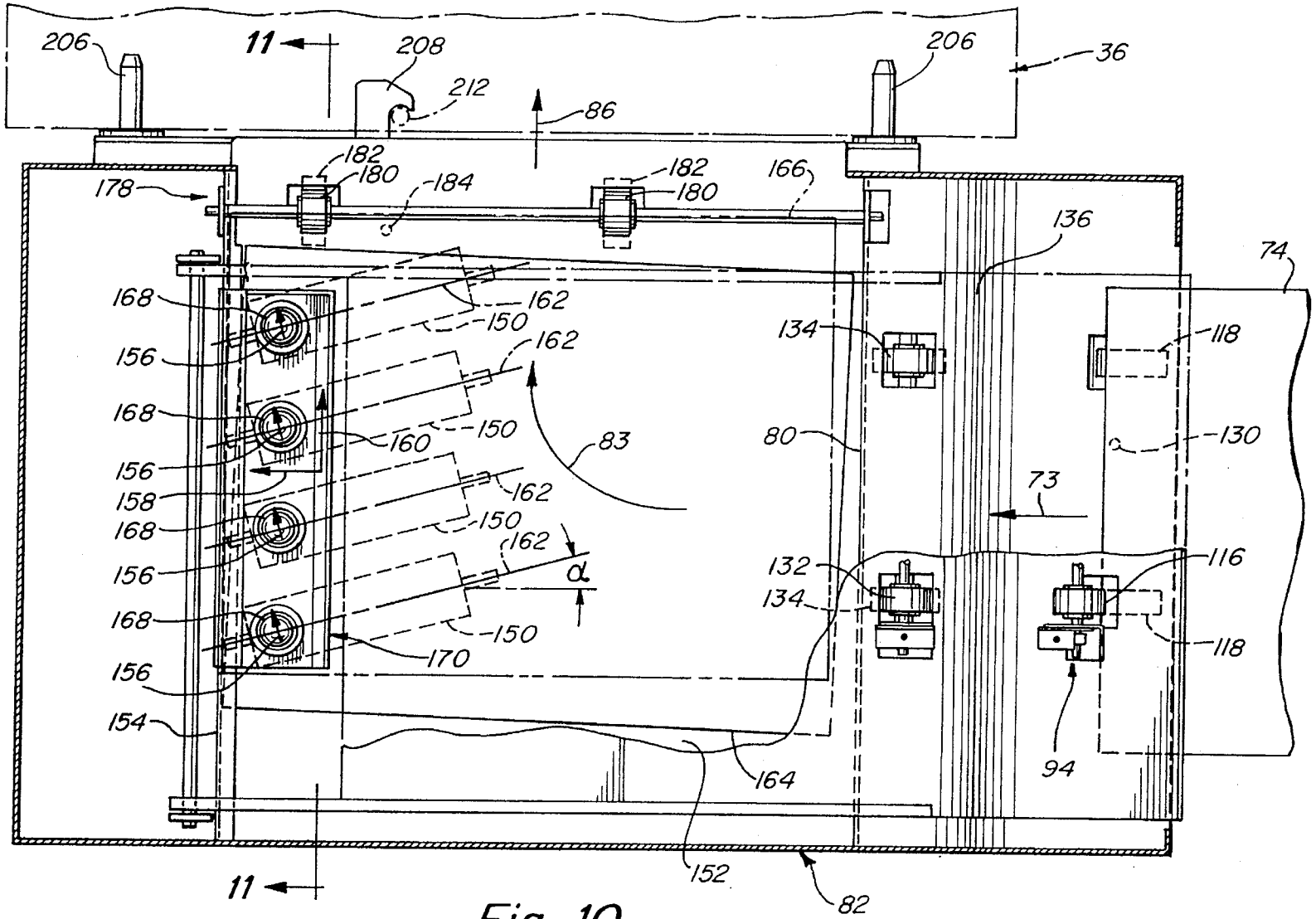
FIG. 10 is a partially exposed plan view of the bump turn unit of FIG. 9.
Figure 11:
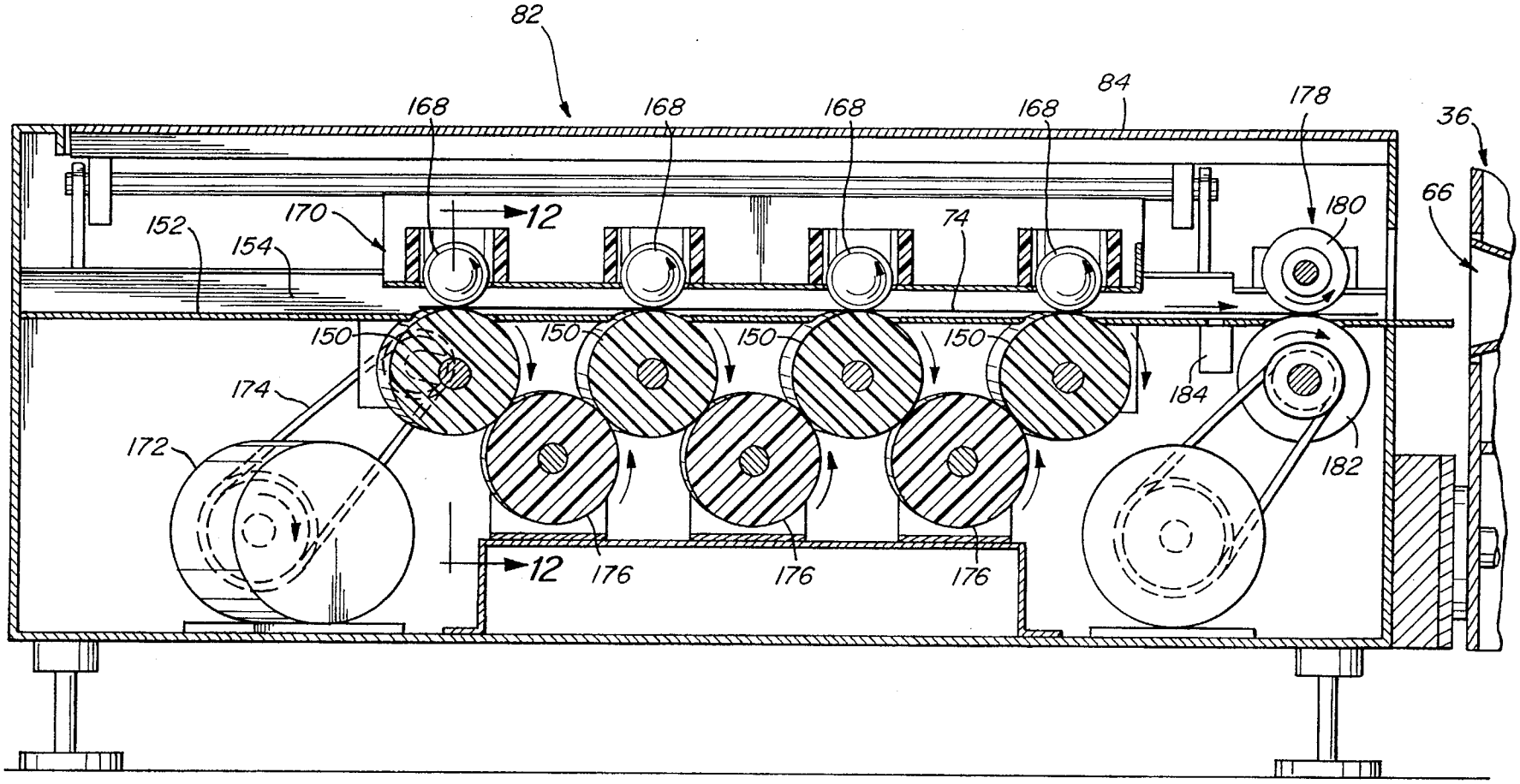
FIG. 11 is a rear cross-section of the bump turn unit taken along line 11—11 of FIG. 10.
Figure 12:
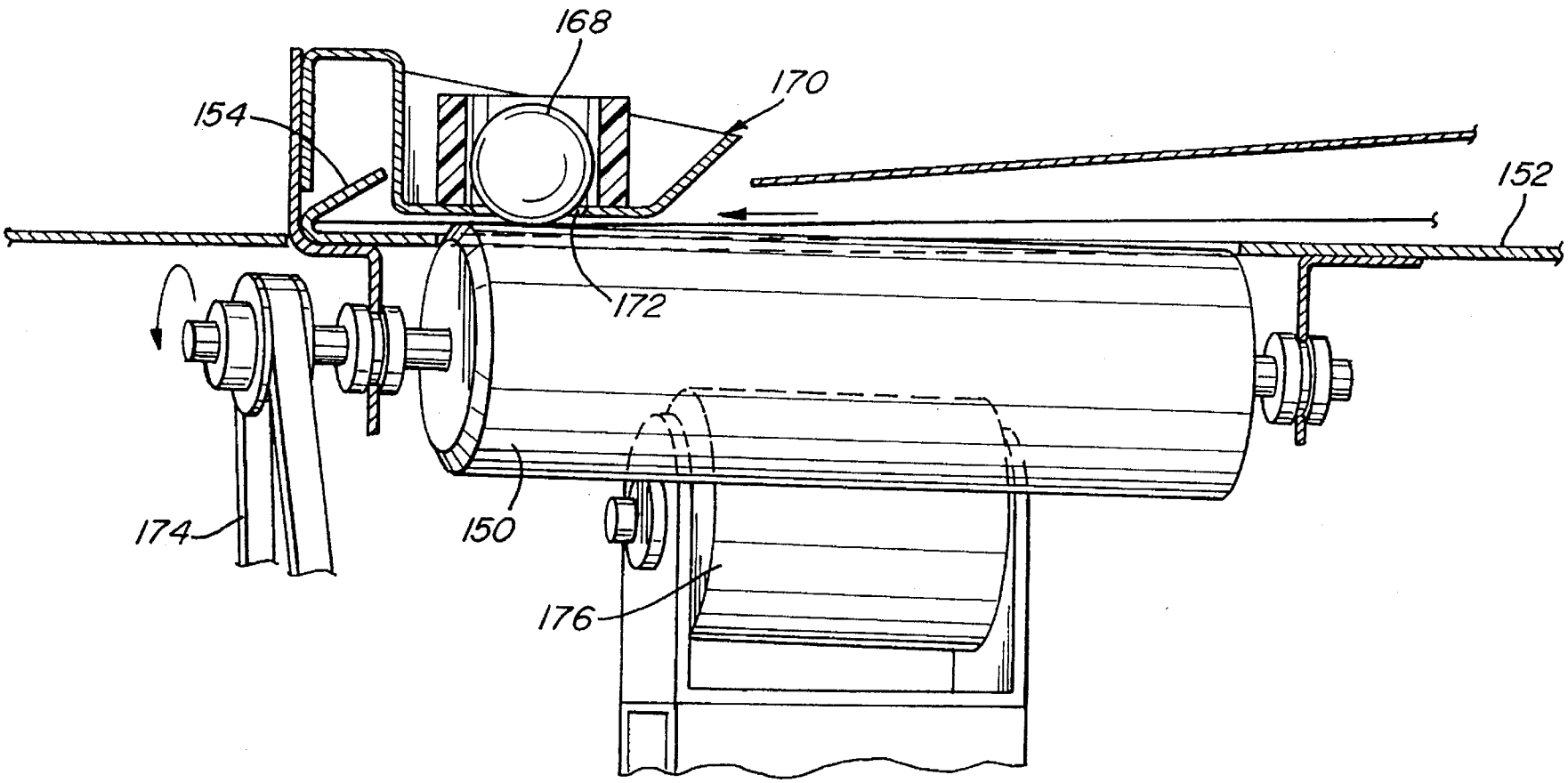
FIG. 12 is a partial side cross-section of the bump turn unit taken along line 12—12 of FIG. 11.

The bump/turn module 82 comprises, according to this embodiment, a plurality of angled rollers 150 detailed variously in FIGS. 5, 9, 10, 11 and 12. The rollers are each approximately 1.25 inches in diameter and approximately 4 inches in length. The rollers are approximately level with the surface 152 of the module 82 and are oriented along an edge guide 154 located at a front most end of the bump/turn module 82. The edge guide 154 is aligned with the direction of sheet feed (arrow 86) through the printer system 20 and is angled inwardly to help prevent sheets from jumping off the surface 152. As sheets pass from the nip rollers 132 and 134 they are driven against the edge guide 154 of the bump/turn module 82. The angled rollers 150 assist in driving sheets into the edge guide 154 by imparting a driving force along the direction of arrows 156 shown in FIG. 10 to the sheets 74. The arrows 156 are resolved into components of force (arrows 158 and 160) that both drive each sheet against the edge guide 154 and drive it toward the printer system port 66. Each roller 150 is disposed so that its axis of rotation 162 is offset at an angle $\alpha$ relative to the ramp's sheet feed direction. $\alpha$, according to this embodiment typically equals 15°. It follows that the rollers' axes of rotation 162 is approximately 75° relative to the line defined by the edge guide 154. Hence, the component along the printer feed direction (arrow 86) is substantially greater than the component along the ramp feed direction (arrow 73). As illustrated in FIG. 10, a skewed sheet 164 is driven against the edge guide 154 so that it is properly justified (as shown in phantom 166) as it is driven in the printer feed direction (arrow 86) toward the port 66.

The bump/turn rollers 150, according to this embodiment, each include a respective ball bearing 168 positioned thereover in a frame 170. Similarly to the justifiers, 88 and 90, the ball bearings 168 are free to rotate to accommodate both ramp feed and printer feed components of motion (vector arrows 158 and 160 respectively). Also, like those of the sheet justifiers 88 and 90, the ball bearings 168 are also free to rise and lower relative to the frame 170 and module surface 152 so that various thickness sheets, and multiple sheets, can be accommodated thereby. The frame 170 can comprise a plate having holes 172 (FIG. 12) sized to allow free rotation of the balls 168. The weight of the balls 168 maintains sheets 74 against the rollers 150 which, in this example, can include a frictional surface material such as polyurethane.

Also, similarly to the justifiers 88 and 90, the weighted balls 168 are chosen so that the generated friction of the rollers 150 on sheets 74 is overcome by context of the sheets with the edge guide 154. The natural rigidity of the sheets 74 prevents buckling when sheets 74 engage the edge guide 154. The angle of $\alpha$ is chosen so that the primary driving component is toward port 66 (arrow 86). Thus, the smaller component directed toward the edge guide 154 merely serves to maintain the sheets 74 against the guide 154 and is transformed primarily into slippage as sheets are driven toward the port 66. Again, the rollers should be positioned near enough to the edge guide 154 so that sheet rigidity is maintained. In this embodiment, the ends of each roller 150 essentially abut the edge guide 154.

The bump/turn rollers 150, according to this invention, can be driven by a variety of systems. In this embodiment, a drive motor 172 is connected by a belt 174 to the most upstream roller. A series of idler rollers 176 are located beneath the surface 152 of the bump/turn module 82 and join each pair of adjacent bump/turn rollers 150. The idler rollers 176 insure that each bump/turn roller 150 rotates at substantially the same speed as each other roller 150. Hence, no undue tension is placed upon a sheet 74 as it proceeds down the rollers 150 in the printer feed direction and it translates evenly against the edge guide 154.

Downstream of the bump/turn module and adjacent the DFA input port 66, is positioned a third wait station 178. This wait station, again, comprises a pair of confronting nip rollers 180 and 182, according to this embodiment, and is detailed in FIGS. 5, 10, and 11. The wait station 178 includes a third sensor 184 that comprises an optical sensor according to this embodiment. When a sheet 74 reaches the nip rollers 180 and 182 (wait station 178) and is served by sensor 184, a sheet-presence registration signal is transmitted by the sensor 184 to the sheet feeder controller that typically signals deactivation of the nip rollers 180 and 182 and bump/turn module rollers 150.

Figure 3:
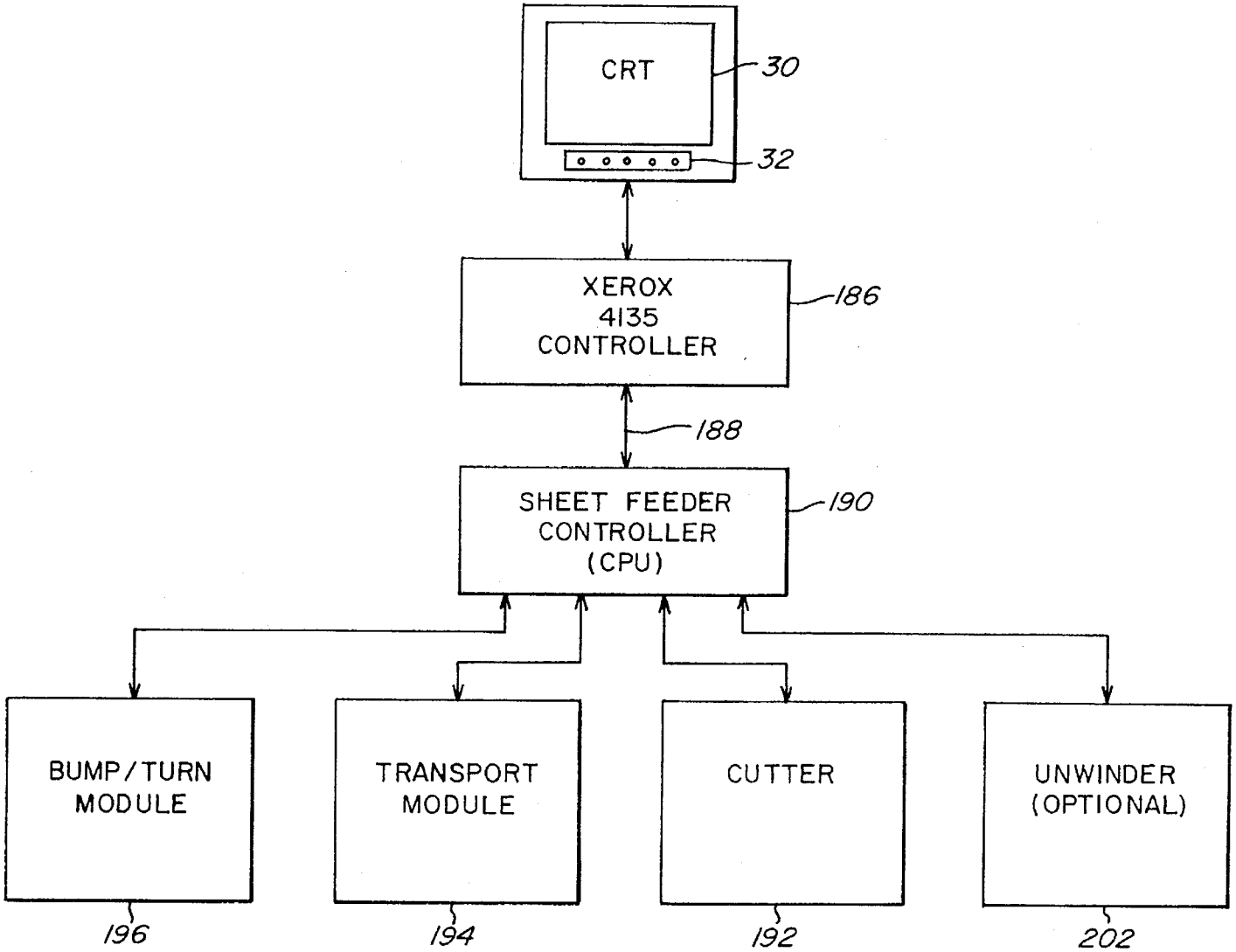
FIG. 3 is a block diagram of the control interconnection between the utilization device and the high speed sheet feeder.
Figure 5:
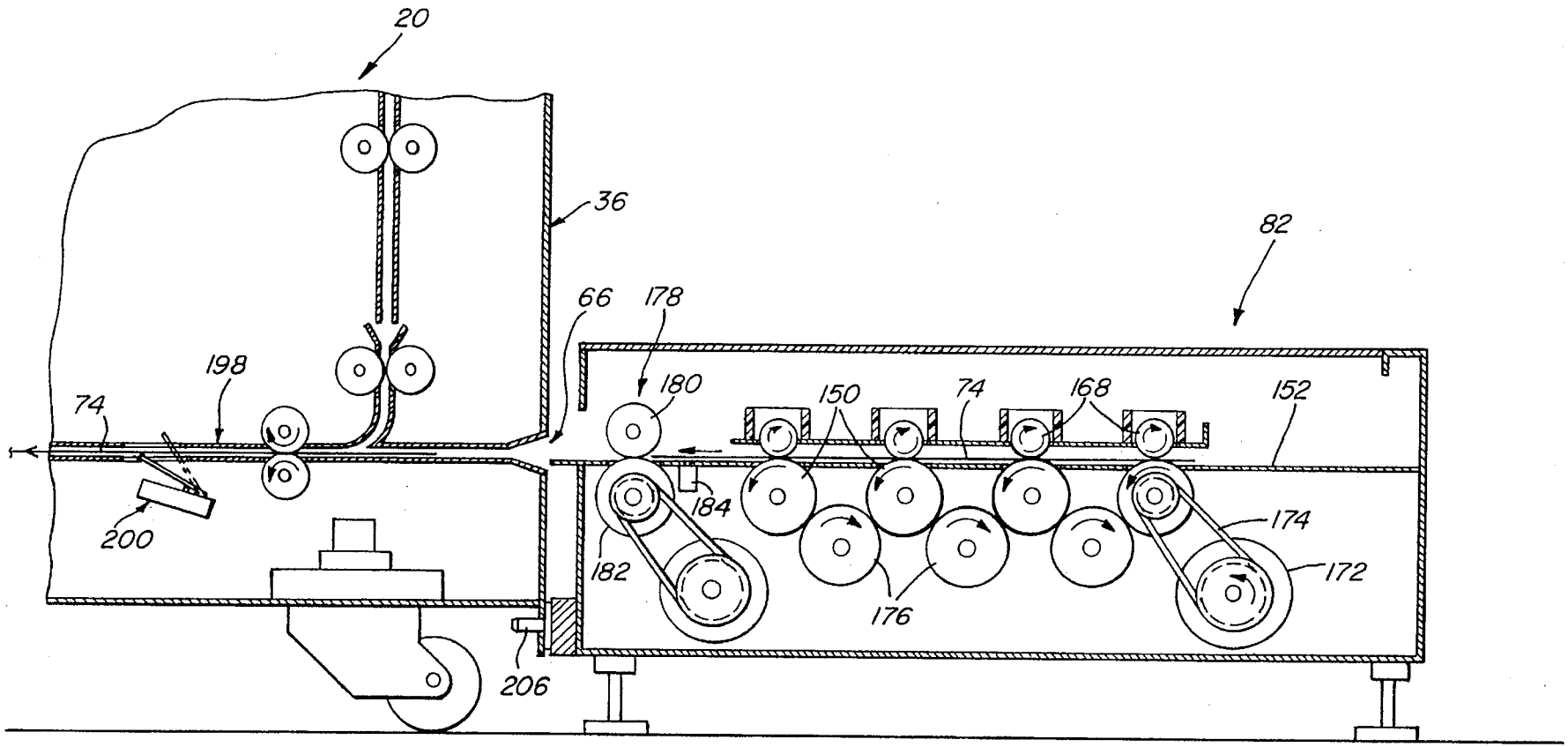
FIG. 5 is a partial schematic cross-section taken along line 5—5 of FIG. 2.

The utilization device, according to this embodiment, which, as described above, can comprise a Xerox 4135 laser printer system 20. As illustrated in FIG. 3, the printer system 20 includes an independent controller 186 (as governed by control panel 32 and CRT 30) that generates a sheet request signal 188 at predetermined times. The sheet request signal 188 prompts the sheet feeder controller 190 to activate each of the cutters 192, transport module 194 (ramp 75 with sheet justifiers 88 and 90 wait stations 92 and 94) and bump/turn module 196. The corresponding motors in the wait stations' justifiers and bump/turn rollers 150 are powered based upon the sheet feeder controller signal to transfer sheets downstream to each successive wait station 88, 90 and 178. In other words, a sheet located in the cutter 70, upon receipt of a sheet request signal 188 from the printer system 20, is transferred to the first wait station. Simultaneously, a sheet from the first wait station 92 is transferred to the second wait station 92, a sheet from the second wait station 94 is transferred to the bump/turn module 82 and then to the third wait station 178 in a single motion, and, simultaneously, the sheet at the third wait station 178 is passed through the port 66 into the DFA 54 and printer raceway 198 (FIG. 5). As each sheet is transferred downstream to the next wait station, the wait station's respective sensor 128, 130,184 signals the sheet feeder controller 190 to de-power or alter the drive speed the associated wait station motors and justifier (or bump/turn) motors. Hence, the sheet pauses or slows at the next downstream location until the next sheet request signal is provided by the printer system 20. Physical interconnection of the system controller 186 to the sheet feeder controller 190 can be accomplished using standard data cables and connectors that are compatible with the printer system 20. In this embodiment, data is transmitted in parallel bit format.

The sheet feeder controller 190, according to this embodiment, includes initialization controls (not shown) that transfer sheets downstream in succession until a sheet is positioned adjacent each of the three wait stations 92, 94 and 178. At start-up, the sheet feeder controller 190 reads each sensor 128, 130 and 184 and continues to transfer sheets downstream until each sensor is triggered by the presence of a sheet. Accordingly, when the sheet feeder 22 is powered on, web 68 is initially driven from the source through the cutter 70, to form sheets 74, and sheets 74 are then driven into each of the three wait station locations. The sheet feeder controller 190 then awaits the first sheet request signal 188 from the printer system controller 186 to drive the first sheet from the third wait station 178 into the raceway 198. Note that the printer system 20 includes a sensor, comprising a microswitch 200, according to this embodiment, in the lower raceway 198 (see FIGS. 2 and 5). This switch 200 is tripped by a passing sheet, and it signals the controller 186 of the printer system 20 that a sheet has been successfully presented to the raceway 198. If a sheet is not presented to the raceway within a predetermined time, the printer controller 186 signals an out-of-paper or jam state and shuts down printing and feeding operations.

In an embodiment adapted for use with a Xerox 4135 printer system, sheets can be fed into the port 66 at a rate of 1194.6 mm per second within a tolerance of +4.6 mm per second and −5.4 mm per second. Such a rate matches relatively closely to the rate of the raceway feed and prevents a jam condition from developing. Similarly, a sheet can be presented at the raceway sensor switch within 500 milliseconds, ±15 milliseconds of the transmission of the sheet request signals (e.g. the time "window" following issuance of a signal). According to a preferred embodiment, a sheet is provided by the third wait station 178 to the port 66 within ±20 milliseconds of the receipt of a sheet request signal. This delay value is typically programmable and the feeder 22, according to this embodiment, allows for relatively rapid presentation of sheets to the printer system DFA port 66. Accordingly, a relatively low delay time is specified in the system controller.

While a particular speed and timing is provided according to this embodiment, the speed and timing can and should be varied depending upon the particular application. Such variation is, thus, expressly contemplated according to this invention.

With further reference to FIG. 3, the sheet feeder controller 190, according to this embodiment, can also be programmed to operate a web unwinder 202 or other feeding device. However, using an unwinder such as disclosed in, for example, applicant's U.S. Pat. Nos. 4,893,763 and 5,000,394, a source of continuous web can be provided automatically upon demand based upon the draw of web 68 by the cutter 70 via a sensed loop located between the cutter 70 and the unwinder (not shown).

Figure 4:
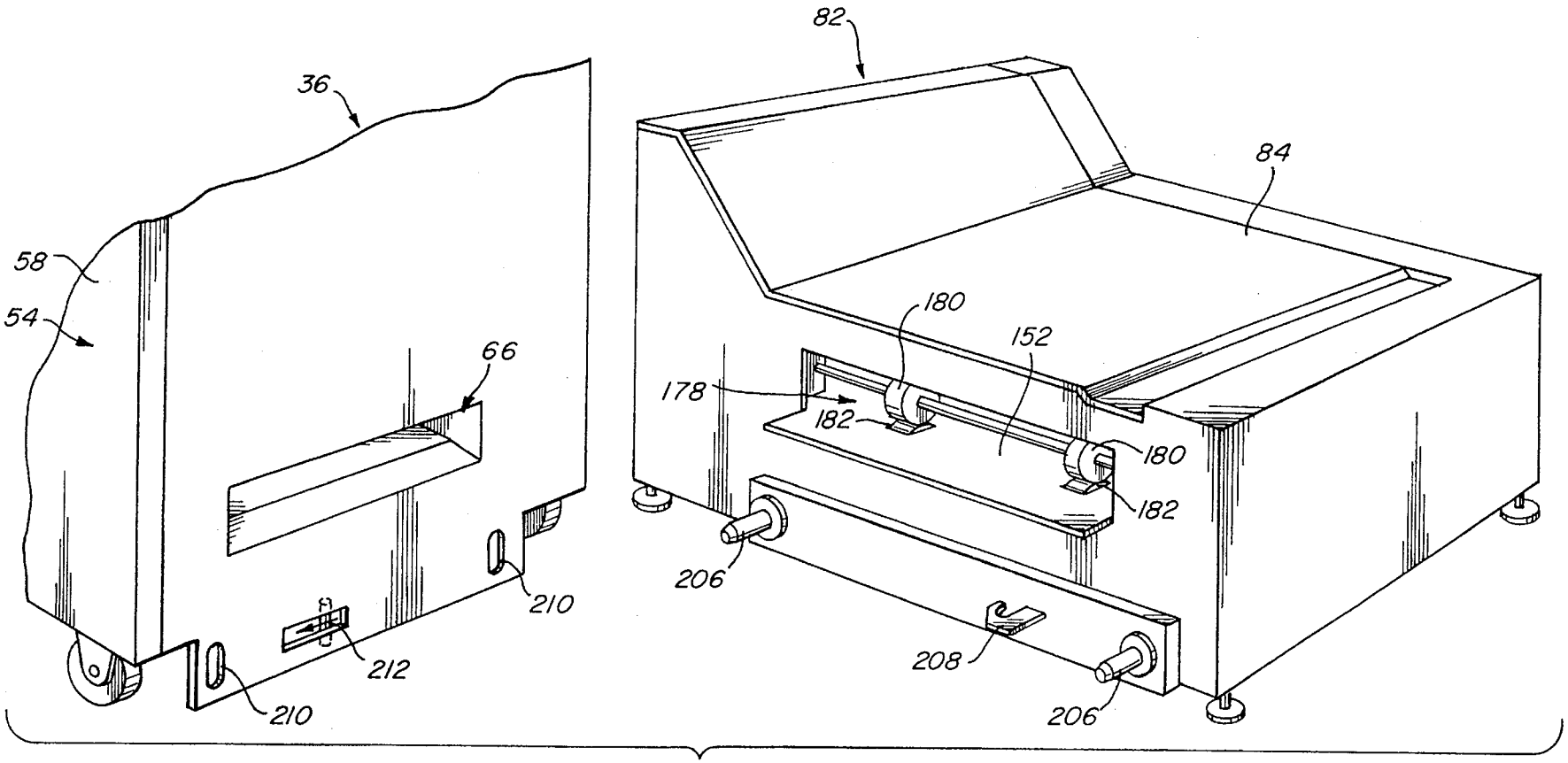
FIG. 4 is a partial perspective view of a utilization device port and the high speed sheet feeder outlet disengaged from each other.

The high speed sheet feeder 22, according to this embodiment, is designed for versatile use. Accordingly, as depicted in FIGS. 4 and 10, the bump/turn module 82 of the sheet feeder 22 according to this embodiment includes a pair of guide pins 206 and a latch 208 that engage with a pair of guide holes 210 and a moveable roller lock 212, respectively on the auxiliary sheet feed unit 36. The pins 206 and lock mechanism 208 and 212 insure tight and accurate alignment between the third wait station 178 and the DFA input port 66. A linkage (not shown) is utilized to release the roller lock 212 so that the sheet feed unit 22 can be rapidly disengaged from the printer system 20 when required and rapidly reengaged at a later time.

The foregoing has been a detailed description of a preferred embodiment. Various modifications and additions can be made without departing from the spirit and scope of this invention. This description is meant to be taken on by way of example and not to otherwise limit the scope of the invention.

What is claimed is:

1. A sheet handling apparatus comprising:

a source of sheets;

a transport unit having a transport surface along which sheets travel in a downstream direction, the transport surface including a first conveyor and a first wait station, each of the first conveyor and the first wait station being operable so that travel of the sheets through the first wait station occurs at a desired first time;

a second wait station positioned downstream of the first wait station and a second conveyor, the second wait station and the second conveyor being located along the transport surface, the second conveyor receiving sheets from the first wait station when the sheets are transferred through the first wait station, the second wait station and the second conveyor being operable so that travel of the sheets through the second wait station occurs at a desired second time;

a directing surface located downstream of each of the first wait station and the second wait station, the directing surface being adjacent the transport surface and being constructed and arranged to receive the sheets from the transport surface and to direct the sheets in the downstream direction into a port of utilization device that receives the sheets at desired delivery times; and a controller that operates the first wait station, the first conveyor, the second wait station and the second conveyor to direct the sheets in the downstream direction in response to a sheet request signal provided by the utilization device, the first conveyor, the first wait station, the second wait station and the second conveyor each being constructed and arranged to direct the sheets in the downstream direction in response to the sheet request signal so that the sheets arrive at the port at the desired delivery times based upon the sheet request signal.

2. A sheet handling apparatus as set forth in claim 1 further comprising a bump/turn module, positioned on the transport surface downstream of the second wait station, that receives sheets of the second wait station and that directs sheets at a right angle relative to a direction sheets are transferred to the bump/turn module from the second wait station, the bump/turn module operating at desired times to deliver sheets onto the directing surface from the transport surface based upon the sheet request signal.

3. A sheet handling apparatus as set forth in claim 2 further comprising a third wait station positioned downstream of the bump/turn module adjacent the directing surface and receiving the sheets from the bump/turn module, the third wait station being selectively operable so that sheets are transferred through the third wait station at desired third times, the third wait station directing the sheets into the port of the utilization device at the desired delivery times based upon the sheet request signal.

4. A sheet handling apparatus as set forth in claim 1 wherein the source of sheets includes a continuous web located upstream of the first conveyor and having a leading end of the web that is directed to the first conveyor and a cutter positioned adjacent the first conveyor that cuts sheets from the continuous web and that presents sheets to the first conveyor.

5. A sheet handling apparatus as set forth in claim 1 wherein at least one of the first conveyor and the second conveyor comprise a moving surface, the moving surface being angled inwardly toward an edge of the transport surface, and wherein the edge includes a raised edge guide so that the sheets are guided against the edge.

6. A sheet handling apparatus as set forth in claim 5 wherein the moving surface comprises an endless belt.

7. A sheet handling apparatus as set forth in claim 5 further comprising a weighted ball located over and in contact with the moving surface to provide pressure to a sheet located therebetween.

8. A sheet handling apparatus as set forth in claim 3 wherein the bump/turn module comprises a plurality of rollers having axes of rotation oriented at a non-perpendicular angle relative to the direction of sheet travel between the second wait station and the bump/turn module.

9. A sheet handling apparatus as set forth in claim 8 wherein the non-perpendicular angle comprises an acute angle.

10. A sheet handling apparatus as set forth in claim 9 wherein the acute angle is approximately 15°.

11. A sheet handling apparatus as set forth in claim 8 further comprising weighted balls contacting at least some of the rollers to provide pressure to a sheet located therebetween.

12. A sheet handling apparatus as set forth in claim 3, wherein at least one of the first wait station, the second wait station and the third wait station includes a sensor that senses the presence of a sheet thereat, the sensor generating a sheet presence signal that is transmitted to the controller.

13. A sheet handling apparatus as set forth in claim 1 wherein the transport surface comprises an inclined surface.

14. A sheet handling apparatus as set forth in claim 13 wherein the inclined surface inclines downwardly in the downstream direction.

15. A sheet handling apparatus as set forth in claim 2 wherein the transport surface comprises an inclined surface that inclines downwardly in a downstream direction.

16. A sheet handling apparatus as set forth in claim 3 wherein at least one of the first wait station, the second wait station and the third wait station comprises a pair of nip rollers that receives and drives a sheet therebetween at one of the desired first time, second time and third time respectively.

17. A sheet handling apparatus as set forth in claim 2 wherein the bump/turn module includes, at a downstream position thereon, a locking mechanism that engages a corresponding locking mechanism adjacent the port of the utilization device.

18. A sheet handling apparatus as set forth in claim 2 wherein the bump/turn module includes a guiding surface that is separated from the transport surface by a step so that the sheets are directed onto the guiding surface of the bump/turn module from a position thereabove.

19. A sheet handling apparatus as set forth in claim 1 wherein the utilization device comprises a high volume printing device having a connector that transmits the sheet request signal to a peripheral device and a dedicated port for receiving sheets from the peripheral device.

* * * * *